US006348441B1

(12) United States Patent
Aiken, III et al.

(10) Patent No.: US 6,348,441 B1
(45) Date of Patent: Feb. 19, 2002

(54) METHOD OF LAUNDERING SOILED FABRICS BY NON-AQUEOUS DETERGENT FORMULATED TO CONTROL DYE TRANSFER AND SUDSING IN HIGH EFFICIENCY WASHING MACHINES

(75) Inventors: John Davis Aiken, III; Murali Sampath, both of Cincinnati; Ronald Allen Swift, II, West Chester, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/713,762

(22) Filed: Nov. 15, 2000

Related U.S. Application Data

(60) Provisional application No. 60/165,647, filed on Nov. 15, 1999.

(51) Int. Cl.[7] ..... C11D 3/395; C11D 7/18; C11D 7/54; C11D 17/08; D06L 11/26

(52) U.S. Cl. ..... 510/304; 510/276; 510/309; 510/312; 510/347; 510/360; 8/137

(58) Field of Search ..... 510/276, 304, 510/309, 312, 347, 360, 367; 8/137

(56) References Cited

U.S. PATENT DOCUMENTS 5,762,647 A * 6/1998 Brown et al. ..... 8/137
5,883,065 A * 3/1999 Swift et al. ..... 510/321
6,169,063 B1 * 1/2001 Kvietok et al. ..... 510/317

* cited by examiner

*Primary Examiner*—Yogendra N. Gupta
*Assistant Examiner*—John M. Petruncio
(74) *Attorney, Agent, or Firm*—C. Brant Cook; Kim W. Zerby; Steven W. Miller

(57) ABSTRACT

Disclosed is a method of laundering soiled fabrics comprising the steps of contacting said fabric in an aqueous laundering solution with a nonaqueous liquid detergent composition containing from about 40% to about 99% by weight of the composition of a surfactant-containing non-aqueous liquid phase and from about 1% to about 50% by weight of the composition of particulate material which is substantially insoluble in said liquid phase and which is selected from peroxygen bleaching agents, bleach activators, organic detergent builders, inorganic alkalinity sources and combinations thereof. A dye transfer inhibitor and suds suppressors are essential components in one aspect of the present invention. The detergent composition is added to the aqueous solution in a washing machine at a concentration in the aqueous solution of from 2000 ppm to about 10,000 ppm, wherein from about 3 gallons to about 8 gallons of water is used to form the aqueous solution, said fabric to water weight ratio is from about 1:1 to about 1:10 and said fabrics undergo a wash time of from about 6 minutes to about 34 minutes.

17 Claims, No Drawings

METHOD OF LAUNDERING SOILED FABRICS BY NON-AQUEOUS DETERGENT FORMULATED TO CONTROL DYE TRANSFER AND SUDSING IN HIGH EFFICIENCY WASHING MACHINES

RELATED APPLICATIONS

This application claims priority under 35 USC 119(e) to U.S. Provisional Patent Application Serial No. 60/165,647 filed Nov. 15, 1999.

FIELD OF THE INVENTION

This invention relates to methods and products for laundering soiled fabrics with liquid laundry detergent products which are non-aqueous and are in the form of stable dispersions of particulate material in a non-aqueous liquid and preferably also includes other materials such as bleaching agents and/or conventional detergent composition adjuvants.

BACKGROUND OF THE INVENTION

In the late Twentieth Century, virtually all consumers in industrialized nations use an automatic clothes washing machine to launder and clean non-delicate fabrics and clothing articles. Generally, such laundering is carried out by placing from about 5 to about 8 pounds of textiles into a top loading washing machine which typically uses about 45 gallons of water. An aqueous laundering solution is formed by adding detergent to the machine in an amount determined by the manufacturer to provide the best cleaning results for a specified amount of textiles, volume of water and soil level. The use of an automatic washer has the advantages of being more convenient, more effective and involves less consumer effort than washing clothes by hand in a sink or wash basin.

But this method of cleaning could be improved, in particular to be less expensive for the consumer to operate. Such savings could be obtained if the amount of water used in such a wash process were reduced which would concomitantly reduce the amount of energy needed to heat the aqueous liquid solution water for the warm and hot washing cycles which generally provide the most detersive benefits. Additionally, further savings could be obtained if the temperature to which the aqueous laundering solution was heated could be reduced. In response to this need, new "high efficiency" washing machines have been developed which not only use less water (up to about ⅔ less water than conventional washing machines) in the wash process but also heat this water to lower wash temperatures than conventional washing machines. These new washing machines represent a significant improvement over existing technology since the cost of each load of clothes cleaned is reduced.

But because currently available high water wash system detergent products are not optimized to work in these newly developed low water wash systems, a consumer may obtain undesirable results when they attempt to use these laundry detergent products in a new high-efficiency machine. Because conventional detergent products are designed to be added to relatively large volumes of aqueous laundering solution, when used in a high-efficiency machine they can produce an excessive amount of foam, which reduces the quality of the washing process and which consumers find aesthetically objectionable. Additionally, dye transfer and/or dirt suspension and/or susceptibility for greater dinginess can be especially difficult conditions to manage in concentrated wash solutions, such as those encountered in high efficiency washing machines. Likewise, because of highly concentrated wash solutions used in high efficiency machines, direct fabric-to-fabric dye transfer ("crocking") sometimes occurs, a phenomenon typically not observed in the more dilute aqueous laundering solution concentrations of a top-loading machine. Furthermore, because "high-efficiency" wash processes generally occur at lower wash temperatures (below 40° C.), in order to provide superior cleaning performance (particularly in removing stains) it is necessary to use additional cleaning adjuvants that are not commonly used in conventional laundry detergent products such as bleaching agents and bleaching systems.

Given the foregoing, there is a continuing need to formulate laundry detergent products which not only effectively control sudsing and dye transfer when used in a low-water, low-temperature washing process, but also provide superior cleaning results through the use of detergent composition components such as bleaching agents and activators.

It is additionally desirable that the above benefits be incorporated into a detergent composition in liquid form. Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Thus because liquid laundry detergents are usually considered to be more convenient to use than granular laundry detergents, they have found substantial favor with consumers.

However, liquid laundry detergents have the disadvantage that laundry detergent composition components which may be compatible with each other in granular products tend to interact or react with each other in a liquid (especially an aqueous liquid) environment. Components such as enzymes, surfactants, perfumes, brighteners, solvents and particularly bleaches and bleach activators can be especially difficult to incorporate into liquid laundry detergent products with an acceptable degree of compositional stability.

It is thus a further benefit of the present invention to provide a liquid laundry detergent composition which is not only specially designed for high-efficiency washing machines but also have physically stable formulations which include bleach agents and activators. One approach for enhancing the chemical compatibility and stability of liquid laundry detergent products has been to formulate non-aqueous (or anhydrous) liquid laundry detergent products. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. However, non-aqueous liquid detergents pose the additional problem that because they are generally formulated with higher amounts of nonionic surfactants, they result in a higher wash pH than most aqueous liquid detergents. At these higher pHs, the inherent dye transfer benefits inherently found in most detergent products are suppressed.

Given the foregoing, there is a continuing need to formulate liquid laundry detergent products, which when used in a "high-efficiency" washing machine, provide excellent cleaning benefits without excessive sudsing or causing fabric damage through dye transfer or other deleterious fabric surface damage.

SUMMARY OF THE INVENTION

It has now been determined that a liquid laundry detergent composition can be prepared which contains a stable bleach and a bleach activator system which provide superior cleaning benefits, as compared to high water wash system liquid laundry detergent compositions, and is suitable for use in a high-efficiency washing machines. In particular it has been found that by preparing nonagueous liquid detergent products comprising a stable suspension of solid, substantially insoluble particulate material (containing at least a bleach and bleach activator) dispersed throughout the liquid, then a stable liquid detergent products with a diverse set of detergent components (particularly a bleaching system) may be formed. Furthermore, by incorporating dye transfer and fabric agents as well as suds suppressors in the detergent composition, than it can be used in a high-efficiency washing machine without the excessive foaming and dye transfer that would result from using conventional detergent compositions.

In a first aspect of the present invention, the nonaqueous liquid laundry compositions are utilized in a method of laundering soiled fabrics comprising the steps of contacting the fabric in an aqueous laundering solution with a non-aqueous liquid detergent composition and said detergent composition being used at a concentration amount in said aqueous solution of from 2000 ppm to about 10,000 ppm. The aqueous solution is formed in a water volume of from about 3 gallons to about 8 gallons; fabrics to be cleaned are added so that the fabric to water weight ratio is from about 1:1 to about 1:10, more preferably from about 1:1 to about 1:9, and said fabrics undergo a wash time of from about 5 minutes to about 40 minutes, more preferably from about 6 minutes to about 34 minutes, even more preferably from about 8 minutes to about 20 minutes, most preferably from about 8 minutes to about 19 minutes. The nonaqueous liquid detergents used in this aspect of the invention comprise from about 40% to about 99% by weight of the composition of a surfactant-containing non-aqueous liquid phase and from about 1% to about 50% by weight of the composition of particulate material which is substantially insoluble in said liquid phase and which is selected from peroxygen bleaching agents, bleach activators, organic detergent builders, inorganic alkalinity sources and combinations thereof, whereby the bleach activator and peroxygen bleaching agent are in a weight ratio of about 0.3:1 to about 5:1 in the detergent composition. Additionally, an essential part of the detergent composition in this aspect is that it includes either in the liquid phase or particulate material both a dye transfer inhibitor and a suds suppressors.

In a second aspect of the invention the method as described above is utilized but a different lower-sudsing surfactant mixture is utilized. This liquid laundry detergent comprises from about 40% to about 99% by weight of the composition of a surfactant-containing non-aqueous liquid phase; from about 1% to about 50% by weight of the composition of particulate material which is substantially insoluble in said liquid phase and which is selected from peroxygen bleaching agents, bleach activators, organic detergent builders, inorganic alkalinity sources and combinations thereof whereby the bleach activator and peroxygen bleaching agent are in a weight ratio of about 0.3:1 to about 5:1 in the detergent composition; from about 0.02% to about 1.00%, by weight, of the composition of a dye transfer inhibitor and from about 0.02% to about 4.00%, by weight, of suds suppressor. In this second aspect of the invention, the surfactant in the surfactant-containing non-aqueous liquid phase is selected from the group consisting of nonionic surfactants, a secondary (2,3) alkyl sulfate surfactant, mid-chain branched surfactants and mixtures thereof. In this aspect, suds suppressors and anti-foaming agents are optional and not essential. If they are present in this aspect of the invention, they are likely to be at lower levels.

All parts, percentages and ratios used herein are expressed as percent weight unless otherwise specified. All documents cited are, in relevant part, incorporated herein by reference.

DETAILED DESCRIPTION OF THE INVENTION

Definitions

As used herein, "non-aqueous" or "anhydrous" are used synonymously and both describe a fluid in which the water content is less than about 5%.

As used herein, the phrase "low-water wash process" refers to a washing process where the total amount of wash and rinse water employed in all cycles of a commercially available washing machine is not more than 30 gallons, preferably less than 25 gallons; in these processes the concentration of the detergent is from about 2,000 parts per million ("ppm") to about 10,000 ppm. In addition, the low water wash process is further characterized by a fabric to water ratio of from about 1:1 to about 1:10, preferably from about 1:1 to about 1:9, more preferably from about 1:5 to about 1:9, a water volume of from about 3 to about 8 gallons and wash time of from about 5 minutes to about 40 minutes, more preferably from about 6 minutes to about 34 minutes, even more preferably from about 8 minutes to about 20 minutes, most preferably from about 8 minutes to about 19 minutes. The water used in such processes is generally at a temperature of less than 40° C., although warmer water may be used if desired.

As used herein, the phrase "effective amount of a dye transfer inhibitor" means that the level of the dye transfer inhibitor in the composition is sufficient to prevent noticeable discoloration of fabrics washed with the composition resulting from the transfer of dye from one fabric article to another, either directly or through the medium of the wash solution.

As used herein, the phrase "effective amount of a suds suppressing system" means that the amount of suds suppressing system in the composition is sufficient to prevent the formation of amounts of foam during a low-water wash process considerably in excess of what it desired by the ordinary consumer.

The liquid laundry detergent compositions of this invention comprise nonaqueous liquid detergent compositions comprising a stable suspension of solid, substantially insoluble particulate material (containing at least a bleach and bleach activator) dispersed in a surfactantcontaining, non-aqueous liquid phase. The components of the liquid phase and the insoluble particulate material are described in greater detail as follows. (All concentrations and ratios are on a weight basis unless otherwise specified.)

Surfactant-containing Liquid Phase

The surfactant-containing, non-aqueous liquid phase will generally comprise from about 40% to 99% by weight of the detergent compositions herein. More preferably, this liquid phase is surfactant-structured and will comprise from about 52% to 98.9% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc. The liquid phase of the detergent compositions herein is preferably formed from one or more non-aqueous organic diluents into which is mixed a surfactant structuring agent.

(a) Non-aqueous Organic Diluents

The major component of the liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 100%, more preferably from about 50% to 80%, most preferably from about 55% to 75%, of a structured, surfactant-containing liquid phase. Preferably the liquid phase of the compositions herein, i.e., the non-aqueous liquid diluent component, will comprise both non-aqueous liquid surfactants and non-surfactant non-aqueous solvents.

i) Non-aqueous Surfactant Liquids

Suitable types of non-aqueous surfactant liquids which can be used to form the liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25-7, Neodol 23-5 and Neodol 23-6.5 by Shell Chemical Company. Other useful Neodols include Neodol 11-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If alcohol alkoxylate nonionic surfactant is utilized as part of the non-aqueous liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

Another type of non-aqueous surfactant liquid which may be utilized in this invention are the ethylene oxide (EO)-propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents, 7th Ed.;* Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. Materials of this type of nonionic surfactant are those which conform to the formula:

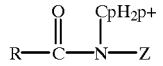

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703, 798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The amount of total liquid surfactant in the preferred surfactant-structured, non-aqueous liquid phase herein will be determined by the type and amounts of other composition components and by the desired composition properties. Generally, the liquid surfactant can comprise from about 35% to 70% of the non-aqueous liquid phase of the compositions herein. More preferably, the liquid surfactant will comprise from about 50% to 65% of a non-aqueous structured liquid phase. This corresponds to a non-aqueous liquid surfactant concentration in the total composition of from about 15% to 70% by weight, more preferably from about 20% to 50% by weight, of the composition.

Also suitable for use in the present invention are low foaming surfactants, such as conventional secondary alkyl sulfate surfactants which are those materials which have the sulfate moiety distributed randomly along the hydrocarbyl "backbone" of the molecule. Such materials may be depicted by the structure:

$$CH_3(CH_2)_n(CHOSO_3^-M^+)(CH_2)_mCH_3$$

wherein m and n are integers of 2 or greater and the sum of m+n is typically about 9 to 15, and M is a water-solubilizing cation, such as an alkali metal, ammonium, alkanolammonium, alkaline earth metal, or the like. Sodium is typical for use as M to prepare the water-soluble (2,3) alkyl sulfates, but ethanolammonium, diethanolammonium, triethanolammonium, potassium, ammonium, and the like, can also be used. These selected secondary (2,3) alkyl sulfate surfactants are taught with more specificity in the Copending application of Todd E. Wichmann, "Granular Detergent Composition Containing Secondary (2,3) Alkyl Sulfate Surfactant and a Bleach/Bleach Activator System," having Ser. No. 08/972,703, filed on Nov. 18, 1997 and incorporated herein by reference.

Other suitable low-foaming surfactants are the mid-chain branched surfactants which are mid-chain branched primary alkyl sulfate surfactants and mid-chain branched primary alkyl alkoxoxylated sulfate surfactants having an average of greater than 14.5 carbon atoms. Mid-chain branched surfactants have the formula:

$$A^b—X—B$$

wherein:

(a) $A^b$ is a hydrophobic $C_9$ to $C_{22}$ chain, preferably from about $C_{12}$ to about $C_{18}$, mid-chain branched alkyl moiety having: (1) a longest linear carbon chain attached to the —X—B moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon, counting from carbon #1 which is attached to the —X—B moiety, to position ω−2 carbon, the terminal carbon minus 2 carbons; and (4) the surfactant composition has an average total number of carbon atoms in the $A^b$—X moiety in the above formula within the range of greater than 14.5 to about 18, preferably from about 15 to about 17; (b) B is a hydrophilic moiety selected from sulfates, sulfonates, amine oxides, polyoxyalkylene, alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated quats, alkylated/polyhydroxylated oxypropyl quats, imidazolines, 2-yl-succinates, sulfonated alkyl esters, and sulfonated fatty acids; and (c) X is —$(CH_2)_n$—. The mid-chain branched surfactants are discussed in greater detail in International Publication WO99/19454, hereby incorporated by reference. Nonionic surfactants also generally low foaming surfactants.

ii) Non-surfactant Non-aqueous Organic Solvents

The liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the rheological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

(b) Surfactant Structurant

The non-aqueous liquid phase of the detergent compositions of this invention is prepared by combining with the non-aqueous organic liquid diluents hereinbefore described a surfactant which is generally, but not necessarily, selected to add structure to the non-aqueous liquid phase of the detergent compositions herein. Structuring surfactants can be of the anionic, nonionic, cationic, and/or amphoteric types.

Preferred structuring surfactants are the anionic surfactants such as the alkyl sulfates, the alkyl polyalkxylate sulfates and the linear alkyl benzene sulfonates. Another common type of anionic surfactant material which may be optionally added to the detergent compositions herein as structurant comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate. Yet another common type of anionic surfactant material which may be employed as a structurant comprises other sulfonated anionic surfactants such as the $C_8$–$C_{18}$ paraffin sulfonates and the $C_8$–$C_{18}$ olefin sulfonates. Structuring anionic surfactants will generally comprise from about 1% to 30% by weight of the compositions herein.

As indicated, one preferred type of structuring anionic surfactant comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^{-M+}$$

wherein R is typically a linear $C_8$–$C_{20}$ hydrocarbyl group, which may be straight chain or branched chain, and M is a water-solubilizing cation. Preferably R is a $C_{10\text{-}14}$ alkyl, and M is alkali metal. Most preferably R is about $C_{12}$ and M is sodium.

Conventional secondary alkyl sulfates, as described above, may also be utilized as a structuring anionic surfactant for the liquid phase of the compositions herein.

If utilized, alkyl sulfates will generally comprise from about 1% to 30% by weight of the composition, more preferably from about 5% to 25% by weight of the composition. Non-aqueous liquid detergent compositions containing alkyl sulfates, peroxygen bleaching agents, and bleach activators are described in greater detail in Kong-Chan et al.; WO 96/10073; Published Apr. 4, 1996, which application is incorporated herein by reference.

Another preferred type of anionic surfactant material which may be optionally added to the non-aqueous cleaning compositions herein as a structurant comprises the alkyl polyalkoxylate sulfates. Alkyl polyalkoxylate sulfates are also known as alkoxylated alkyl sulfates or alkyl ether sulfates. Such materials are those which correspond to the formula $$R^2—O—(C_mH_{2m}O)_n—SO_3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium. Ammonium, alkylammonium and alkanolammonium counterions are preferably avoided when used in the compositions herein because of incompatibility with peroxygen bleaching agents.

If utilized, alkyl polyalkoxylate sulfates can also generally comprise from about 1% to 30% by weight of the composition, more preferably from about 5% to 25% by weight of the composition. Non-aqueous liquid detergent compositions containing alkyl polyalkoxylate sulfates, in combination with polyhydroxy fatty acid amides, are described in greater detail in WO 96/33254 which is incorporated herein by reference.

The most preferred type of anionic surfactant for use as a structurant in the compositions herein comprises the linear alkyl benzene sulfonate (LAS) surfactants. In particular, such LAS surfactants can be formulated into a specific type of anionic surfactant-containing powder which is especially useful for incorporation into the non-aqueous liquid detergent compositions of the present invention. Such a powder comprises two distinct phases. One of these phases is insoluble in the non-aqueous organic liquid diluents used in the compositions herein; the other phase is soluble in the non-aqueous organic liquids. It is the insoluble phase of this preferred anionic surfactant-containing powder which can be dispersed in the non-aqueous liquid phase of the preferred compositions herein and which forms a network of aggregated small particles that allows the final product to stably suspend other additional solid particulate materials in the composition.

Further descriptions of suitable surfactants, and methods for preparing such surfactants can be found in International Publication WO98/00516, which is hereby incorporated by reference.

(c) Suds Suppressing System

Suds suppression can be of particular importance in the present invention because of the high concentration of the detergent composition. The use of suds suppressors in "high concentration cleaning process" is described in greater detail U.S. Pat. Nos. 4,489,455 and 4,489,574. Suds Suppressors typically comprise from about 0.01% to about 4.00% by weight of the composition, preferably from about 0.01% to about 1.50%, and more preferably from about 0.06% to about 0.60%.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons, N-alkylated amino triazines, monostearyl phosphates, silicone suds suppressors, secondary alcohols (e.g., 2-alkyl alkanols) and mixtures of such alcohols with silicone oils. Hydrocarbon suds suppressors are described, for example, in U.S. Pat. No. 4,265,779, issued May 5, 1981 to Gandolfo et al. Silicone suds suppressors are well known in the art and are, for example, disclosed in U.S. Pat. No. 4,265,779, issued May 5, 1981 to Gandolfo et al and EP 354 016. Mixtures of alcohols and silicone oils are described in U.S. Pat. Nos. 4,798,679, 4,075,118 and EP 150,872.

Additional examples of all of the aforementioned suds suppressors may be found in the International Publication WO00/27958, which is hereby incorporated by reference.

The preferred particulate foam control agent used herein contains a silicone antifoam compound, an organic material and a carrier material onto which the silicone antifoam compound and the organic material are deposited. The carrier material is preferably a native starch or zeolite. The silicone antifoam compound is selected from the group consisting of polydiorganosiloxane, solid silica and mixtures thereof. Preferably, the organic material is selected from:

(a) at least one fatty acid having a carbon chain containing from 12 to 20 carbon atoms, said organic material having a melting point in the range 45° C. to 80° C. and being insoluble in water;

(b) at least one fatty alcohol, having a carbon chain containing from 12 to 20 carbon atoms, said organic material having a melting point in the range 45° C. to 80° C. and being insoluble in water;

(c) a mixture of at least one fatty acid and one fatty alcohol, each having a carbon chain containing from 12 to 20 carbon atoms, said organic material having a melting point in the range 45° C. to 80° C. and being insoluble in water;

(d) an organic material having a melting point in the range 50° C. to 85° C. and comprising a monoester of glycerol and a fatty acid having a carbon chain containing from 12 to 20 carbon atoms; and (e) a dispersing polymer; and mixtures thereof.

Preferably, the dispersing polymer is selected from the group consisting of copolymers of acrylic acid and maleic acid, polyacrylates and mixtures thereof.

Silicone suds suppressors known in the art which can be used are, for example, disclosed in U.S. Pat. No. 4,265,779, issued May 5, 1981 to Gandolfo et al and EP 354 016. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987. An exemplary silicone based suds suppressor for use herein is a suds suppressing amount of a particulate foam control agent consisting essentially of:

(a) polydimethylsiloxane fluid having a viscosity of from about 20 cs. to about 1,500 cs. at 25° C.;

(b) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units of from about 0.6:1 to about 1.2:1; and (c) from about 1 to about 20 parts per 100 parts by weight of (i) of a solid silica gel.

Additional suds suppressor suitable for use in the present invention are described in greater detail in U.S. Pat. No. 5,762,647, issued Jun. 9, 1998, to Brown et al.

An alternative to suds suppressors is the formulation of the compositions of the present invention to resist and/or inhibit suds/foam production. For example, the composition may comprise a surfactant system comprising anionic surfactants, such as linear alkylbenzene sulfonate, and a nonionic surfactants, such as NEODOL® and a fatty acid, such as topped palm kernel fatty acid in amount such that foaming is resisted and/or inhibited.

(d) Dye Transfer Inhibiting Agents

The compositions of the present invention may also include one or more materials effective for inhibiting the transfer of dyes from one fabric to another during the cleaning process. These agents may be included either in the nonaqueous surfactant-containing liquid phase or in the solid particulate material.

Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. These agents typically comprise from about 0.02% to about 1.00%, by weight, of the composition, preferably from about 0.02% to about 0.50%, and more preferably from about 0.05% to about 0.2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

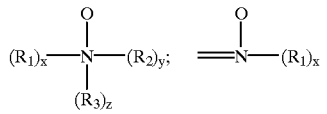

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000.

The most preferred polyamine N-oxide useful in the detergent compositions herein is poly(4-vinylpyridine-N-oxide) which as an average molecular weight of about 50,000 and an amine to amine N-oxide ratio of about 1:4. This preferred class of materials can be referred to as "PVNO".

Further suitable dye transfer inhibitors can be found in U.S. Pat. No. 5,466,802, issued Nov. 14, 1995 to Panandiker et al., which is hereby incorporated by reference.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Solid Particulate Materials

In addition to the surfactant-containing liquid phase, the non-aqueous detergent compositions herein also preferably comprise from about 1% to 50% by weight, more preferably from about 29% to 44% by weight, of additional solid phase particulate material which is dispersed and suspended within the liquid phase. Generally such particulate material will range in size from about 0.1 to 1500 microns, more preferably from about 0.1 to 900 microns. Most preferably, such material will range in size from about 5 to 200 microns.

The additional particulate material utilized herein can comprise one or more types of detergent composition components which in particulate form are substantially insoluble in the non-aqueous liquid phase of the composition. Such materials include bleaching systems, such as peroxygen bleaching agents and bleach activators, as well as other bleaching agents, organic detergent builders, inorganic alkalinity sources and combinations thereof. The types of particulate materials which can be utilized are described in detail, below, as follows, however, some materials can either be included in the particulate component or in the surfactant-containing non-aqueous liquid phase. For example, the surfactant structuring agents are formed by mixing liquid and paste surfactants together with anionic surfactant-containing powder; a portion of this anionic surfactant-containing powder may remain undissolved in the liquid phase upon completion of mixing. Thus surfactant may be found in the present invention in both the solid and liquid phases. Where a component could be included in either phase it has been noted.

In a preferred embodiment the particulate material comprises the dye transfer inhibitor PVNO (see above for detailed description), an aluminosilicate detergent builder as well as other particulate minor components.

Bleaching System

The compositions of the present invention preferably comprise a bleaching system. Bleaching systems typically comprise a "bleaching agent" (source of hydrogen peroxide) and an "initiator" or "catalyst". When present, bleaching agents will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

Bleaching Agents—Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

(a) Bleach Activators—Preferably, the peroxygen bleach component in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate (CIO-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl) amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U. S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present laundry compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl)oxybenzenesulfonate,(6-nonanamidocaproyl) oxybenzenesulfonate, (6-decanamidocaproyl)oxybenzenesulfonate and mixtures thereof.

Other useful amido-derived bleach activators are described in U.S. Pat. No. 5,891,838 issued Apr. 6, 1999 to Angell et al., and International Publication WO99/64556, both of which are incorporated herein by reference.

Other useful activators, disclosed in U.S. Pat. Nos. 5,698,504, 5,695,679, 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety—$C(O)OC(R^1)$═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat Nos. 5,698,504, 5,695,679 and 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

The detergent compositions herein may also optionally contain bleach activators which are liquid in form at room temperature and which can be added as liquids to the non-aqueous liquid phase of the detergent compositions herein. One such liquid bleach activator is acetyl triethyl citrate (ATC). Other examples include glycerol triacetate and nonanoyl valerolactam. Liquid bleach activators can be dissolved in the non-aqueous liquid phase of the compositions herein.

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts—The present invention compositions and methods may utilize metal-containing bleach catalysts that are effective for use in bleaching compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

Manganese Metal Complexes—If desired, the compositions herein can be catalyzed by means of a manganese compound. Such compounds and levels of use are well known in the art and include, for example, the manganese-based catalysts disclosed in U.S. Pat. No. 5,576,282; 5,246,621; 5,244,594; 5,194,416; and 5,114,606; and European Pat. App. Pub. Nos. 549,271 A1, 549,272 A1, 544,440 A2, and 544,490 A1; Preferred examples of these catalysts include $Mn_{IV2}(u\text{-}O)_3$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$-(1,4,7-trimethyl-1,4,7-triazacyclononane)$_2(ClO_4)_3$, $Mn^{IV(}$1,4,7-trimethyl-1,4,7triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes—Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co\text{-}(NH_3)_5Oac](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410;

*J. Chem. Ed.* (1989), 66 (12 ), 1043–45; The Synthesis and Characterization of Inorganic Compounds, W. L. Jolly (Prentice-Hall; 1970), pp. 461–3; *Inorg. Chem,* 18, 1497–1502 (1979); *Inorg. Chem.,* 21, 2881–2885 (1982); *Inor. Chem.,* 18, 2023–2025 (1979); Inorg. Synthesis, 173–176 (1960); and *Journal of Physical Chemistry,* 56, 22–25 (1952).

Transition Metal Complexes of Macropolycyclic Rigid Ligands—Compositions herein may also suitably include as bleach catalyst a transition metal complex of a macropolycyclic rigid ligand. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or laundry uses, and non-limitingly illustrated by any of the following:

Dichloro-5,12-dimethyl-1,5,8,12-tetraazabicyclo[6.6.2] hexadecane Manganese(II)

Dichloro-5,12-diethyl-1,5,3,12-tetraazabicyclo[6.6.2] hexadecane Manganese(II)

Diaquo-5,12-dimethyl-1,5,8,12-tetraazabicyclo[6.6.2] hexadecaneManganese(II) Hexafluorophosphate Diaquo-5,12-diethyl-1,5,8,12-tetraazabicyclo[6.6.2] hexadecaneManganese(II) Hexafluorophosphate Aquo-hydroxy-5,12-dimethyl-1,5,8,12-tetraazabicyclo [6.6.2]hexadecane Manganese(III) Hexafluorophosphate Diaquo-5,12-dimethyl-1,5,8,12-tetraazabicyclo[6.6.2] hexadecaneManganese(II) Tetrafluoroborate Dichloro-5,12-dimethyl-1,5,8,12tetraazabicyclo[6.6.2] hexadecane Manganese(III) Hexafluorophosphate Dichloro-5,12-diethyl-1,5,8,12-tetraazabicyclo[6.6.2] hexadecaneManganese(III) Hexafluorophosphate Dichloro-5,12-di-n-butyl-1,5,8,12-tetraaza bicyclo[6.6.2] hexadecane Manganese(II)

Dichloro-5,12-dibenzyl-1,5,8,12-tetraazabicyclo[6.6.2] hexadecaneManganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II)

Dichloro-5-n-butyl-12-methyl-1,5,8,12-tetraaza-bicyclo [6.6.2]hexadecane Manganese(II).

As a practical matter, and not by way of limitation, the compositions and laundry processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(d) Other Bleach Catalysts—The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

(e) Bleach Boosting Compounds—The compositions herein may comprise one or more bleach boosting compounds. Bleach boosting compounds provide increased bleaching effectiveness in lower temperature applications. The bleach boosters act in conjunction with conventional peroxygen bleaching sources to provide increased bleaching effectiveness.

Suitable bleach boosting compounds for use in accordance with the present invention comprise cationic imines, zwitterionic imines, anionic imines and/or polyionic imines having a net charge of from about +3 to about −3, and mixtures thereof. These imine bleach boosting compounds of the present invention include those of the general structure:

[I]

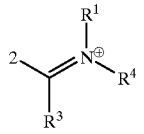

where $R^1$–$R^4$ may be a hydrogen or an unsubstituted or substituted radical selected from the group consisting of phenyl, aryl, heterocyclic ring, alkyl and cycloalkyl radicals.

Preferred bleach boosting compounds include where $R^1$–$R^4$ may be a hydrogen or an unsubstituted or substituted radical selected from the group consisting of phenyl, aryl, heterocyclic ring, alkyl and cycloalkyl radicals except that at least one of $R^1$–$R^4$ contains an anionically charged moiety.

More preferred bleach boosting compounds include the anionically charged moiety bonded to the imine nitrogen. Such bleach boosting compounds comprise quaternary imine zwitterions represented by the formula:

[II]

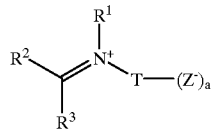

wherein $R^1$–$R^3$ is hydrogen or an unsubstituted or substituted radical selected from the group consisting of phenyl, aryl, heterocyclic ring, alkyl and cycloalkyl radicals; $R_1$ and $R_2$ form part of a common ring; T has the formula:

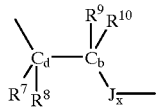

wherein x is equal to 0 or 1; J, when present, is selected from the group consisting of $—CR^{11}R^{12}—$, $—CR^{11}R^{12}CR^{13}R^{14}—$, and $—CR^{11}R^{12}CR^{13}R^{14}CR^{15}R^{16}$; $R^7$–$R^{16}$ are individually selected from the group consisting of H, linear or branched $C_1$–$C_{18}$ substituted or unsubstituted alkyl, alkylene, oxyalkylene, aryl, substituted aryl, substituted arylcarbonyl groups and amide groups; Z is covalently bonded to $J_x$ when x is 1 and to $C_b$ when x is 0, and Z is selected from the group consisting of —$CO_2^-$, —$SO_3^-$and —$OSO_3^-$and a is 1. $R_1$ and $R_2$ together may form the non-charged moiety:

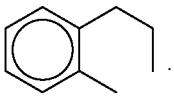

Most preferred bleach boosting compounds include are aryliminium zwitterions wherein $R_3$ is H, Z is —$SO_3^-$or —$OSO_3^-$, and a is 1. The aryliminium zwitterions may have the formula:

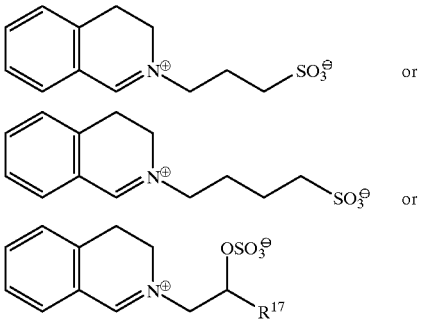

where $R^{17}$ is selected from the group consisting of H and linear or branched $C_1$–$C_{18}$ substituted or unsubstituted alkyl, preferably $C_1$–$C_{14}$ alkyl and even more preferably $C_8$–$C_{10}$ linear alkyl chain.

The bleach boosting compounds may also comprise an aryliminum polyion having a net negative charge and $R^3$ is H, T is —$(CH_2)_b$— or —$CH_2(C_6H_4)$—, Z is —$SO_3^-$, a is 2 and b is from 2 to 4. The aryliminium polyion preferably has the formula:

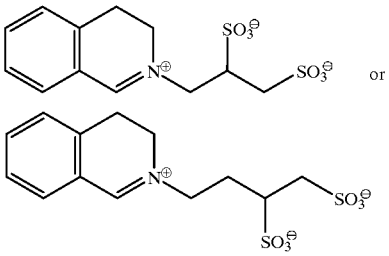

or is a water-soluble salt of these compounds.

The quaternary imine bleach boosting compounds preferably act in conjunction with a peroxygen source to provide a more effective bleaching system. The bleach boosting compounds react with the peroxygen source to form a more active bleaching species, an oxaziridinium compound. The formed oxaziridinium compounds are either cationic, zwitterionic or polyionic with a net negative charge as was the imine bleach boosting compound. The oxaziridinium compound has an increased activity at lower temperatures relative to the peroxygen compound. The oxaziridinium compound is represented by the formula:

(III)

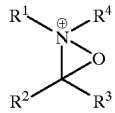

and can be produced from the imine of formula (I) or (II), wherein $R^4$ is T—$(Z^-)_a$, of the present invention with the reaction:

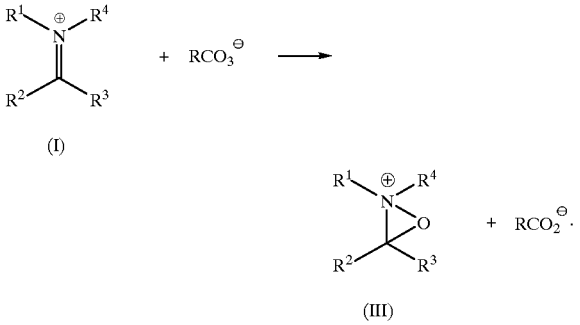

Thus, the preferred bleach boosting compounds of the present invention represented by the formula (II) produces the active oxaziridinium bleaching species represented by the formula:

(IV)

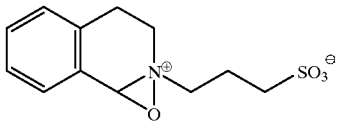

or (V)

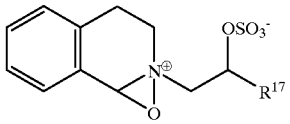

wherein $R^{17}$ is defined as above.

Peroxygen sources are well-known in the art and the peroxygen source employed in the present invention may comprise any of these well known sources, including peroxygen compounds as well as compounds which under consumer use conditions provide an effective amount of peroxygen in situ. The peroxygen source may include a hydrogen peroxide source, the in situ formation of a peracid anion through the reaction of a hydrogen peroxide source and a bleach activator, preformed peracid compounds or mixtures of suitable peroxygen sources. Of course, one of ordinary skill in the art will recognize that other sources of peroxygen may be employed without departing from the scope of the invention.

The bleach boosting compounds, when present, are preferably employed in conjunction with a peroxygen source in the bleaching compositions of the present invention. In such a composition, the peroxygen source is preferably present at a level of from about 0.1% to about 60% by weight of the composition, and more preferably from about 1% to about 40% by weight of the composition. In the composition, the bleach boosting compound is preferably present at a level of from about 0.01% to about 10% by weight of the composition, and more preferably from about 0.05% to about 5% by weight of the composition.

(f) Preformed Peracids—Also suitable as bleaching agents are preformed peracids, such as phthalimido-peroxycaproic acid ("PAP"). See for example U.S. Pat. Nos. 5,487,818, 5,310,934, 5,246,620, 5,279,757 and 5,132,431.

(g) Photobleaches—Suitable photobleaches for use in the treating compositions of the present invention include, but are not limited to, the photobleaches described in U.S. Pat. Nos. 4,217,105 and 5,916,481.

(h) Enzyme Bleaching—Enzymatic systems may be used as bleaching agents. The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Pat. No. Application 91202655.6 filed Oct. 9, 1991.

The present invention compositions and methods may utilize alternative bleach systems such as ozone. Bleaching with ozone may be accomplished by introducing ozone-containing gas having ozone content from about 20 to about 300 $g/m^3$ into the solution that is to contact the fabrics. The gas:liquid ratio in the solution should be maintained from about 1:2.5 to about 1:6. U.S. Pat. No. 5,346,588 describes a process for the utilization of ozone as an alternative to conventional bleach systems and is herein incorporated by reference.

Organic Builder Material

Another possible type of additional particulate material which can be suspended in the non-aqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark which have molecular weight ranging from about 5,000 to 100,000.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

Inorganic Alkalinity Sources

Another possible type of additional particulate material which can be suspended in the non-aqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the additional particulate material component, the alkalinity source will generally comprise from about 1% to 25% by weight of the compositions herein. More preferably, the alkalinity source can comprise from about 2% to 15% by weight of the composition. Such materials, while water-soluble, will generally be insoluble in the non-aqueous detergent compositions herein.

Other Optional Composition Components

In addition to the composition liquid and solid phase components as hereinbefore described, the detergent compositions herein can, and preferably will, contain various other optional components. Such optional components may be in either liquid or solid form. The optional components may either dissolve in the liquid phase or may be dispersed within the liquid phase in the form of fine particles or droplets. Some of the other materials which may optionally be utilized in the compositions herein are described in greater detail as follows:

Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Optional Enzymes

The detergent compositions herein may also optionally contain one or more types of detergent enzymes. Such enzymes can include proteases, amylases, cellulases and lipases. Such materials are known in the art and are commercially available. They may be incorporated into the non-aqueous liquid detergent compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the non-aqueous liquid compositions herein at levels sufficient to provide up to about 10 mg by weight, more typically from about 0.01 mg to about 5 mg, of active enzyme per gram of the composition. Stated otherwise, the non-aqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Compositions of the present invention may comprise one or more enzymes which provide cleaning performance benefits. Said enzymes include enzymes selected from cellulases, hemicellulases, peroxidases, proteases, glucoamylases, amylases, lipases, cutinases, pectinases, xylanases, reductases, oxidases, phenoloxidases, lipoxygenases, ligninases, pullulanases, tannases, pentosanases, malanases, β-glucanases, arabinosidases, mannanases, xyloglucanases or mixtures thereof. A preferred combination is a fabric care composition having a cocktail of conventional applicable enzymes like protease, amylase, lipase, cutinase, mannanases, xyloglucanases and/or cellulase. Enzymes when present in the compositions, at from about 0.0001% to about 5% of active enzyme by weight of the fabric care composition.

Proteases for use in the fabric care compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the fabric care composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of Bacillus amyloliquefaciens subtilisin, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Published Application Nos. WO 99/20727, WO 99/20726, and WO 99/20723 all owned by The Procter & Gamble Company.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of Amylases (α and/or β) can be included for removal of carbohydrate-based stains. WO94/02597 describes laundry compositions which incorporate mutant amylases. See also WO95/10603. Other amylases known for use in laundry compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314 and WO96/05295, Genencor, and amylase variants having additional modification in the immediate parent available from Novo Nordisk A/S, disclosed in WO 95/10603. Also suitable are amylases described in EP 277 216.

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebaso α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. Preferably, the mannanase is selected from the group consisting of: three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase and mixtures thereof. (IUPAC Classification-Enzyme nomenclature, 1992 ISBN 0-12-227165-3 Academic Press).

More preferably, the compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

The compositions of the present invention may also comprise a xyloglucanase enzyme. Suitable xyloglucanases for the purpose of the present invention are enzymes exhibiting endoglucanase activity specific for xyloglucan, preferably at a level of from about 0.001% to about 1%, more preferably from about 0.01% to about 0.5%, by weight of the composition. As used herein, the term "endoglucanase activity" means the capability of the enzyme to hydrolyze 1,4-β-D-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 μmol reducing sugar/min from a glucan substrate, the glucan substrate being, e.g., CMC (CMCU), acid swollen Avicell (AVIU), xyloglucan (XGU) or cereal β-glucan (BGU). The reducing sugars are determined as described in WO 94/14953 and hereinafter. The specific activity of an endoglucanase towards a substrate is defined as units/mg of protein.

Optional Chelating Agents

The detergent compositions herein may also optionally contain a chelating agent which serves to chelate metal ions, e.g., iron and/or manganese, within the nonaqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Additional Fabric Care Agents

In addition to the dye transfer inhibitors, the present invention further comprises additional agents to provide fabric care benefits. As described above, these additional agents may be necessary because the high concentrations of detergent concentration in the aqueous laundering solutions used in the present invention may damaged the garments and fabrics contact by the aqueous laundering solutions.

Thus the present invention may also include materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. Such fabric appearance benefits can include, for example, improved overall appearance of the laundered fabrics, reduction of the formation of pills and fizz, protection against color fading, improved abrasion resistance, etc.

Other suitable fabric care agents for use in the present detergent compositions include dye maintenance polymers.

One example of such a polymer is the Adduct of Imidazole-epichlorohydrin:

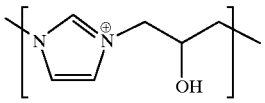

(Idealized Structure)

This has a ratio of imidazole:epichlorohydrin of 1.36:1. Further dye maintenance polymers as well as the Dye Maintenance Parameter Test are described in the International Publication WO00/22077, which is hereby incorporated by reference. As described above, these dye maintenance polymers provide overall fabric care benefits in addition to color care protection.

Another suitable fabric care agent for use in the present detergent compositions is hydrophobically modified cellulosic based polymers or oligomers, which are discussed in greater detail in the International Publication WO00/22078, which is hereby incorporated by reference.

Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

Other suitable polymeric materials suitable for use as thickening, viscosity control and/or dispersing agents include polymers of: castor oil derivatives; polyurethane derivatives, and polyethylene glycol.

Also suitable for use in the present invention are special hydrotropes which have been shown to have a very favorable effect on the viscosity and rheological behavior of a liquid detergent composition. These hydrotropes have two polar groups are separated from each other by at least 5, preferably 6, aliphatic carbon atoms prevents the formation of the viscous lamellar phase. Examples of suitable polar groups for inclusion in the hydrotrope include are hydroxyl and carboxyl ions. Particularly preferred hydrotropes are 1,4 Cyclo Hexane Di Methanol, 1,6 Hexanediol, and 1,7 Heptanediol. Mixtures of these organic molecules or any number of hydrotropes molecules which consist of two polar groups separated from each other by at least 5, preferably 6, aliphatic carbon atoms are also acceptable. These hydrotropes are discussed in greater detail in the copending provisional application of Jean-Paul Boutique et al., entitled "Detergent Compositions Comprising Improved Hydrotropes", filed on Aug. 23, 1999 and having P&G Case No. 7694P2.

If utilized, the optional thickening, viscosity control and/or dispersing agents should be present in the compositions herein to the extent of from about 0.1% to 4% by weight. More preferably, such materials can comprise from about 0.1 % to 2% by weight of the detergents compositions herein.

Optional Clay Soil Removal/Anti-redeposition Agents

The compositions of the present invention can also optionally contain water-soluble ethoxylated amines having clay soil removal and anti-redeposition properties. If used, soil materials can contain from about 0.01% to about 5% by weight of the compositions herein.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-anti-redeposition agents are the cationic compounds disclosed in European Pat. No. Application 111,965, Oh and Gosselink, published Jun. 27, 1984. Other clay soil removal/anti-redeposition agents which can be used include the ethoxylated amine polymers disclosed in European Pat. No. Application 111,984, Gosselink, published Jun. 27, 1984; the zwitterionic polymers disclosed in European Pat. No. Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein. Another type of preferred anti-redeposition agent includes the carboxy methyl cellulose (CMC) materials. These materials are well known in the art.

Optional Brighteners, Dyes and/or Perfumes

The detergent compositions herein may also optionally contain conventional brighteners, bleach catalysts, dyes and/or perfume materials. Such brighteners, silicone oils, bleach catalysts, dyes and perfumes must, of course, be compatible and non-reactive with the other composition components in a non-aqueous environment. If present, brighteners, dyes and/or perfumes will typically comprise from about 0.0001% to 2% by weight of the compositions herein.

Structure Elasticizing Agents

The non-aqueous liquid detergent compositions herein can also contain from about 0.1% to 5%, preferably from about 0.1% to 2% by weight of a finely divided, solid particulate material which can include silica, e.g., fumed silica, titanium dioxide, insoluble carbonates, finely divided carbon, SD-3 bentone, clays, or combinations of these materials. Clays are well known to those skilled in the art and are commercially available from companies such as Rheox. Fine particulate material of this type functions as a structure elasticizing agent in the products of this invention. Such material has an average particle size ranging from about 7 to 40 nanometers, more preferably from about 7 to 15 nanometers. Such material also has a specific surface area which ranges from about 40 to 400 $m^2/g$.

The finely divided elasticizing agent material can improve the shipping stability of the non-aqueous liquid detergent products herein by increasing the elasticity of the surfactant-structured liquid phase without increasing product viscosity. This permits such products to withstand high frequency vibration which may be encountered during shipping without undergoing undersirable structure breakdown which could lead to sedimentation in the product.

In the case of titanium dioxide, the use of this material also imparts whiteness to the suspension of particulate material within the detergent compositions herein. This effect improves the overall appearance of the product.

Additional Particulate Materials

In addition to the components of the particulate, solid phase described above, the present invention may also comprise low-density particles, particularly microspheres. Suitable microspheres may be made of one or more water-insoluble materials selected from the group consisting of: polymers; silicaceous materials; ceramics and mixtures thereof. For further discussion of microspheres, see "Microencapsulation" in Kirk-Othmer Encyclopedia of Chemical Technology, Third Edition, Volume 16, pages 628–651 (John Wiley & Sons, Inc., 1979), which is hereby incorporated by reference.

Commercially available microspheres are available from Akzo-Nobel of Sweden under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEEX®.

Microspheres are discussed in greater detail in the copending provisional application of Jean-Paul Boutique et al., entitled "Detergent Compositions Comprising Improved Hydrotropes", filed on Aug. 23, 1999 and having P&G Case No. 7694P2, incorporated above. Methods for coating microspheres are discussed in the copending provisional application of Yousef Aouad et al., entitled "Nonaqueous Liquid Detergent with Wash-water soluble Low-Density Filler Particles", having P&G Case No. 7708P, and filed on Aug. 10, 1999, which is hereby incorporated by reference. Biomaterial microspheres are also discussed in the copending provisional application of Eugene S. Sadlowski et al, entitled "Nonaqueous Liquid Detergent With Wash-Water Soluble Low-Density Filler Particles", having P&G Case No. 7707P, filed on Aug. 10, 1999, which is hereby incorporated by reference.

Also suitable are low-density particles dried in such a way that they are completely or partially hollow. Such particles may be made from a variety of ingredients, notably organic and inorganic builder material, alkalinity source material and other particle ingredient components such as polymers, binding agents and chelants. This particular species of low-density particle is described in more detail in the copending provisional application of Yousef G. Aouad et al., entitled "Nonaqueous Liquid Detergent with Water-Soluble, Low-Density Particles", having P&G Case No. 7747P, Ser. No. 60/150,431, filed on Aug. 24, 1999.

Composition Form

As indicated, the non-aqueous liquid detergent compositions herein are in the form of bleaching agent and/or other materials in particulate form as a solid phase suspended in and dispersed throughout a surfactant-containing, preferably structured non-aqueous liquid phase. Generally, the structured non-aqueous liquid phase will comprise from about 45% to 95%, more preferably from about 50% to 90%, by weight of the composition with the dispersed additional solid materials comprising from about 5% to 55%, more preferably from about 10% to 50%, by weight of the composition.

The particulate-containing liquid detergent compositions of this invention are substantially non-aqueous (or anhydrous) in character. While very small amounts of water may be incorporated into such compositions as an impurity in the essential or optional components, the amount of water should in no event exceed about 5% by weight of the compositions herein. More preferably, water content of the non-aqueous detergent compositions herein will comprise less than about 1% by weight.

The particulate-containing non-aqueous liquid detergent compositions herein will be relatively viscous and phase stable under conditions of commercial marketing and use of such compositions. Frequently the viscosity of the compositions herein will range from about 300 to 5,000 cps, more preferably from about 500 to 3,000 cps. For purposes of this invention, viscosity is measured with a Carrimed CSL2 Rheometer at a shear rate of 20 $s^{-1}$.

Composition Preparation and Use

The preparation of non-aqueous liquid detergent compositions is discussed in detail in International Publication WO98/00516, which is hereby incorporated by reference.

The nonaqueous liquid detergent compositions of the present invention are particularly suited for use in the low-water wash processes; such process are most typically found in "high-efficiency" automatic washing machines. In a low-water wash process the total amount of wash and rinse water employed in all cycles of a commercially available washing machine is not more than 30 gallons, preferably less than 25 gallons. Additionally, the nonaqueous liquid detergent composition used is these low-water wash processes is used at a concentration amount in said aqueous solution of from about 2000 ppm to about 10,000 ppm, wherein the water volume during any individual cycle of the wash process is from about 3 gallons to about 8 gallons. Generally, the water used during the wash process is always at a temperature of less than about 40° C., preferably less than about 30° C. The fabric to water weight ratio during the process is from about 1:1 to about 1:9 and said fabrics undergo a wash time of from about 8 minutes to about 16 minutes.

The following examples illustrate the preparation and performance advantages of the solid particulate-containing non-aqueous liquid detergent compositions of the instant invention. Such examples, however, are not necessarily meant to limit or otherwise define the scope of the invention herein.

EXAMPLE I

Non-Aqueous Liquid Detergent Compositions with Bleach suitable for use in "high-efficiency" washing machines were prepared as follows.

| Component | Example 1 Wt % Active | Example 2 Wt % Active |
|---|---|---|
| Anionic surfactant | 15.9 | 15.9 |
| Nonionic Surfactant | 20.4 | 20.4 |
| BPP solvent | 18.1 | 9.5 |
| Acetyl triethyl citrate | — | 9.5 |
| Bleach Activator | 5.9 | 2.9 |
| Hydrotrope | 4.9 | 3.8 |

-continued

| Component | Example 1 Wt % Active | Example 2 Wt % Active |
|---|---|---|
| Ethoxylated diamine quat | 1.2 | 1.2 |
| Sodium Citrate Dihydrate | 3.3 | 3.3 |
| Sodium Carbonate | 9.8 | 9.5 |
| maleic-acrylic copolymer | 2.9 | 2.9 |
| Chelant | 1.4 | 1.4 |
| Enzyme Prills | 1.6 | 1.6 |
| Sodium Perborate | 11.8 | 14.24 |
| Silicone | 0.2 | 0.2 |
| Perfume | 1.2 | 1.2 |
| Titanium Dioxide | 0.5 | 0.5 |
| Dye Transfer Inhibitor | 0.2 | 0.2 |
| Brightener | 0.2 | 0.2 |
| Misc | to 100% | to 100% |

The resulting compositions of Examples 1and 2 are stable, non-aqueous, heavy-duty liquid laundry detergent products. These products may then be used in a high-efficiency washing machine in the following manner:

Step 1. Between 3 to 8 lbs of garments are selected and placed into a high-efficiency washing machine. (This corresponds to a fabric to water ratio of between 1:1 and 1:10.) Care should be taken that the load is properly balanced. If desired, before placing the fabrics into the washing machine, a consumer may identify stains on the fabrics from sources such as ink, lipstick, salad dressing, collar soil and other similar and pretreat them Step 2. The washing machine is set to a water level of approximately 5 gallons and water temperature and agitation settings are set appropriate to the type and color of garments and their degree of soiling, generally the water temperature will be below about 40° C. One dose (about 70 ml) of the liquid product of either Example I or Example II is dosed into the washing machine dispenser or via a dosing cup directly into the drum; 70 ml of the liquid product of Example I in 5 gallons of water means that the total concentration of the liquid product in the detergent/water solution will be about 3800 ppm. The washing machine is then started.

Step 3. The washing machine will run through a "wash" cycle lasting between about 10 to 16 minutes. At the conclusion of the "wash" cycle, the wash liquor is drained from the wash tub and fresh water is added to the tub to rinse the detergent suds and film which is accumulated on the textiles. Multiple rinse cycles may be used when needed. This water is then removed from the drum and to remove as much excess water as possible, the textiles next enter a "spin" cycle whereby they are spun dry by the high-speed rotation of the washing machine drum.

Step 4. When the washing machine has completed all of its cycles, the garments are removed from the washing machine.

The method outlined above when used in combination with the exemplified products provides excellent stain and soil removal performance.

EXAMPLE II

A Non-Aqueous Liquid Detergent Composition with Bleach suitable for use in "high-efficiency" washing machines is prepared as follows.

| Component | Example 3 Wt. % |
|---|---|
| Anionic surfactant | 6 |
| Nonionic Surfactant | 23 |
| Acetyl triethyl citrate | 5 |
| TAED bleach activator | 3 |
| Sodium Carbonate | 17 |
| Sodium Perborate | 10.5 |
| Silicone | 1 |
| Silica | 3 |
| Dye Transfer Inhibitor | 0.2 |
| Brightener | 0.1 |
| Calcite | 1 |
| Misc | to 100% |
| Total | 100 |

The resulting composition of Example 3 is a stable, non-aqueous, heavy-duty liquid laundry detergent product. This product is used in the method described above to provide excellent stain and soil removal performance.

What is claimed is:

1. A method of laundering soiled fabrics in a high efficiency automatic washing machine, which method comprises the steps of:

a) forming an aqueous laundering solution in said washing machine, said solution containing from about 2000 ppm to about 10,000 ppm of a non aqueous liquid detergent composition in from about 3 gallons to about 8 gallons of water;

b) adding soiled fabrics to said aqueous solution such that the weight ratio of fabric to laundering solution ranges from about 1:1 to 1:10; and c) washing said fabrics in said solution for a period of time ranging from about 6 to 34 minutes;

wherein said nonaqueous liquid detergent composition contains:

i) from about 40% to about 99% by weight of the composition of a surfactant-containing non-aqueous liquid phase;

ii) from about 1% to about 50% by weight of the composition of a particulate material which is substantially insoluble in said liquid phase and which comprises materials selected from the group consisting of peroxygen bleaching agents, bleach activators, organic detergent builders, inorganic alkalinity sources and combinations thereof;

iii) an effective amount of a dye transfer inhibitor; and iv) an effective amount of a suds suppressor.

2. A method according to claim 1, wherein the dye transfer inhibitor is contained in the surfactant-containing liquid phase.

3. A method according to claim 1, wherein the dye transfer inhibitor is contained in the particulate material.

4. A method according to claim 1 wherein the temperature of the aqueous solution is less than about 40° C.

5. A method according to claim 1, wherein the suds suppressor is contained in the particulate material.

6. A method of laundering soiled fabrics in a high efficiency automatic washing machine, which method comprises the steps of:

a) forming an aqueous laundering solution in said washing machine, said solution containing from about 2000 ppm to about 10,000 ppm of a non aqueous liquid detergent composition in from about 3 gallons to about 8 gallons of water;

b) adding soiled fabrics to said aqueous solution such that the weight ratio of fabric to laundering solution ranges from about 1:1 to 1:10; and c) washing said fabrics in said solution for a period of time ranging from about 6 to 34 minutes;

wherein said nonaqueous liquid detergent composition contains:

i) from about 40% to about 99% by weight of the composition of a surfactant-containing non-aqueous liquid phase;

ii) from about 1% to about 50% by weight of the composition of a particulate material which is substantially insoluble in said liquid phase and which comprises materials selected from the group consisting of peroxygen bleaching agents, bleach activators, organic detergent builders, inorganic alkalinity sources and combinations thereof;

iii) from about 0.02% to about 1% of a dye transfer inhibitor; and iv) from about 0.02% to about 4% of a suds suppressor.

7. A method according to claim 1, wherein the suds suppressor comprises a silicone foam control agent.

8. A method according to claim 1, wherein the suds suppressor comprises a fatty acid ester.

9. A method according to claim 1, wherein the detergent composition includes from about 0.01% to about 10% of a fabric care agent.

10. A method according to claim 1, wherein the whereby the bleach activator and peroxygen bleaching agent are in a weight ratio of about 0.3:1 to about 5:1.

11. A method according to claim 6, wherein the mid-chain branched surfactants is selected from compounds of the formula a secondary (2,3) alkyl sulfate surfactant, $$A^b—X—B$$

wherein:

(a) $A^b$ is a hydrophobic $C_9$ to $C_{22}$, preferably from about C12 to about C18, mid-chain branched alkyl moiety having:

(1) a longest linear carbon chain attached to the —X—B moiety in the range of from 8 to 21 carbon atoms;

(2) one or more $C_1$–$C_3$ alkyl moieties branching from this longest linear carbon chain;

(3) at least one of the branching alkyl moieties is attached directly to a carbon of the longest linear carbon chain at a position within the range of position 2 carbon, counting from carbon #1 which is attached to the —X—B moiety, to position ω–2 carbon, the terminal carbon minus 2 carbons; and (4) the surfactant composition has an average total number of carbon atoms in the $A^b$—X moiety in the above formula within the range of greater than 14.5 to about 18, preferably from about 15 to about 17;

(b) B is a hydrophilic moiety selected from sulfates, sulfonates, amine oxides, polyoxyalkylene, alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated quats, alkylated/polyhydroxylated oxypropyl quats, imidazolines, 2-ylsuccinates, sulfonated alkyl esters, and sulfonated fatty acids; and (c) X is —$CH_2$—.

12. A method of laundering soiled fabrics according to claim 1 wherein the nonaqueous liquid detergent comprises from about 0.02% to about 1.00% of a dye transfer inhibitor and from about 0.01% to about 4.00% of a suds suppressor.

13. A method according to claim 1, wherein the surfactant-containing non-aqueous liquid phase has a density of from about 0.6 to 1.4 g/cc.

14. A method according to claim 1, wherein the particulate material has a particle size of from about 0.1 to about 1500 microns.

15. A method according to claim 1, wherein the particulate material the particulate material comprises an aluminosilicate detergent builder and a poly(4-vinylpyridine-N-oxide) having an average molecular weight of about 50,000 and an amine to amine N-oxide ratio of about 1:4.

16. An article of manufacture comprising a container containing a nonaqueous liquid detergent composition; wherein the container has instructions for using the detergent composition; wherein the instructions include the step of using the nonaqueous liquid detergent composition into low-water wash process according to the method of laundering soiled fabric of claim 1.

17. An article of manufacture according to claim 16 wherein the nonaqueous liquid detergent composition comprises:

a) from about 40% to about 99% by weight of the composition of a surfactant-containing non-aqueous liquid phase; and b) from about 1% to about 50% by weight of the composition of a particulate material which is substantially insoluble in said liquid phase and which comprises materials selected from the group consisting of peroxygen bleaching agents, bleach activators, organic detergent builders, inorganic alkalinity sources and combinations thereof;

c) an effective amount of a dye transfer inhibitor; and d) an effective amount of a suds suppressor.

* * * * *